United States Patent [19]

Hunter

[11] Patent Number: 4,600,195

[45] Date of Patent: Jul. 15, 1986

[54] WEIGHTED GOLF CLUB HANDLE

[76] Inventor: James J. Hunter, P.O. Box 3117, 52 Chapman Ct., Page, Ariz. 86040

[21] Appl. No.: 710,656

[22] Filed: Mar. 11, 1985

[51] Int. Cl.[4] ..... A63B 53/16

[52] U.S. Cl. ..... 273/81 A

[58] Field of Search ..... 273/81.2, 80 A, 81 C, 273/81 R, 81 A; 272/122, 124

[56] References Cited

U.S. PATENT DOCUMENTS

| | | | |
|---|---|---|---|
| 937,225 | 10/1909 | Burr | 272/122 |
| 1,026,990 | 5/1912 | Matson | 273/81 A |
| 3,342,489 | 9/1967 | Waldo | 273/81 A |
| 3,606,327 | 9/1971 | Gorman | 273/81 A |
| 3,639,069 | 2/1972 | Gordon | 273/81 R |

FOREIGN PATENT DOCUMENTS

| | | | |
|---|---|---|---|
| 100690 | 4/1937 | Australia | 273/81 R |

*Primary Examiner*—Richard C. Pinkham
*Assistant Examiner*—Stuart W. Rose
*Attorney, Agent, or Firm*—Joseph H. Roediger

[57] ABSTRACT

An improved golf club wherein a plurality of weights are removably attached to the free end of the club shaft in alignment with the shaft axis in order to place the center of gravity of the club closer to the hand-grippable region of the shaft.

3 Claims, 5 Drawing Figures

WEIGHTED GOLF CLUB HANDLE

BACKGROUND OF THE INVENTION

This invention relates to a sport device of the type used in striking a sport object and propelling it at a distance from the user and in particularly, an improved golf club wherein player control is enhanced.

A number of sporting activities require the participant to grasp and move a sport device, be it a golf club, croquet or polo mallet in a controlled manner to strike and propel an object typically, a ball, toward a defined goal. In case of the game of golf, the goal is very much reduced in size so that very precise strokes are needed to ultimately place the sport object in the hole.

The overall weight of the club determines whether or not the user has sufficient strength to handle the club. Adjustments to the overall weight are typically made by adding material at the handle and/or in the region where the clubhead or striking surface is joined to the end of the club shaft. In the case of golf clubs, this region proximate to the head is termed the hosel. While overall weight is significant for the user, performance is affected as well by the swing weight of the club.

In the athletic goods industry, swing weight of a club refers to the relationship of the clubhead weight to the overall weight of the club. The swing weight scale has sixty gradations each of which signifies a certain ratio of weights apart from the overall club weight. As the clubhead weight increases with an increasing swing weight, the shaft bends more during the swing and the club swings heavier and slower. The traditional method of altering swing weight in a golf club is to disassemble the club and add or subtract lead in the hosel region where the head meets the shaft. However, the swing weight can also be altered during manufacture by adding weight to the handle region if the clubhead can no longer tolerate the removal of additional material.

The combination of simultaneously changing clubhead and handle-region weights to accommodate a particular player's preference without altering the overall weight of the club has been suggested in the past. The adjustments needed to move several gradations on the swing weight scale are slight since one gradation is approximately equal to the weight of a dollar bill. An experienced golfer can typically sense a variation of three gradations in swing weight.

While swing weight is important for the feel and performance of clubs used to propel the ball large distances, the significance thereof decreases when the distances are shorter. Stability of the club when within the player's grasp is increasingly important as the accuracy demanded of the club increases, the most sensitive club being the putter with which the ball is taken to the hole. The need for enhanced stability has generated a family of golf clubs wherein weight distribution within the club head has been altered without changing overall club weight or the swing weight. Primarily this occurred through the concentration of the head weight in regions on either side of the striker by making the surface area smaller or reducing its thickness.

These steps to provide clubs with variable swing weights or altered clubheads have concentrated their efforts on maintain- ing the overall weight characteristics constant. These changes have relied upon the use of techniques acting within the length of the club and to this end have not directed their attention to providing stabilization by intentionally moving the center of gravity of the club closer to the hand-grip region of the club.

Accordingly, it is an object of the present invention to provide sport clubs with improved stability especially those clubs wherein the need for accuracy is paramount. This invention enables the user to alter the distance with which the center of gravity of the club is moved along the shaft without requiring assistance from the manufacturer or a technician. Furthermore, this invention can be installed on existing clubs and still permit modification of the effect by the user according to his perception of the stabilizing effect required for his game.

SUMMARY OF THE INVENTION

The present invention is directed to an improved sporting device for contacting and propelling a sport object with accuracy to a target while the device is within the grasp of the participant.

The improved device includes an elongated shaft having a free end proximate to which is located hand-grip means for assisting the user in retaining the device within his grasp during operation. Typically, the hand-grip means includes an antifriction material wrapped about the shaft.

A striking member or clubhead is affixed to the opposing end of the shaft. The design of the clubhead is a feature of choice by the user.

Weighting means is attached to the free end of the shaft and extends outwardly therefrom in the axial direction. The weighting means increases the mass of the sporting device and moves the center of gravity of the device along the shaft toward the hand-grip means. By utilizing a segmented weighting means comprising at least first and second sections, the distance that the center of gravity is moved along the axis of the shaft can be varied.

The first section is affixed to the free end of the shaft and additional sections are removably attached to the first section and to each other. Each adjacent section in the preferred embodiment is in threaded engagement with the adjacent section so the number of sections comprising the weighting means can be varied by the user.

By moving the center of gravity along the axis of the shaft toward the hand-grippable region on the shaft, the dynamic effect of using the sporting device is altered. The presence of the weighting means above the hand-grippable portion has been found to make the club seem easier to swing. This effect is most apparent in a golf putter though it is normally experienced on all types of golf clubs. The present invention increases the overall weight of the club and coupled with the additional weight in axial alignment with the shaft but overlying the hands produces a stabilizing effect on the movement of the clubhead which typically increases the accuracy of the club and the reproducibility of the swing.

Further features and advantages of the invention will become more readily apparent from the following detailed description of a specific embodiment of the invention when taken in conjunction with the accompanying drawings.

DESCRIPTION OF THE PREFERRED EMBODIMENTS

Figures 1, 2, 3, 4, 5:
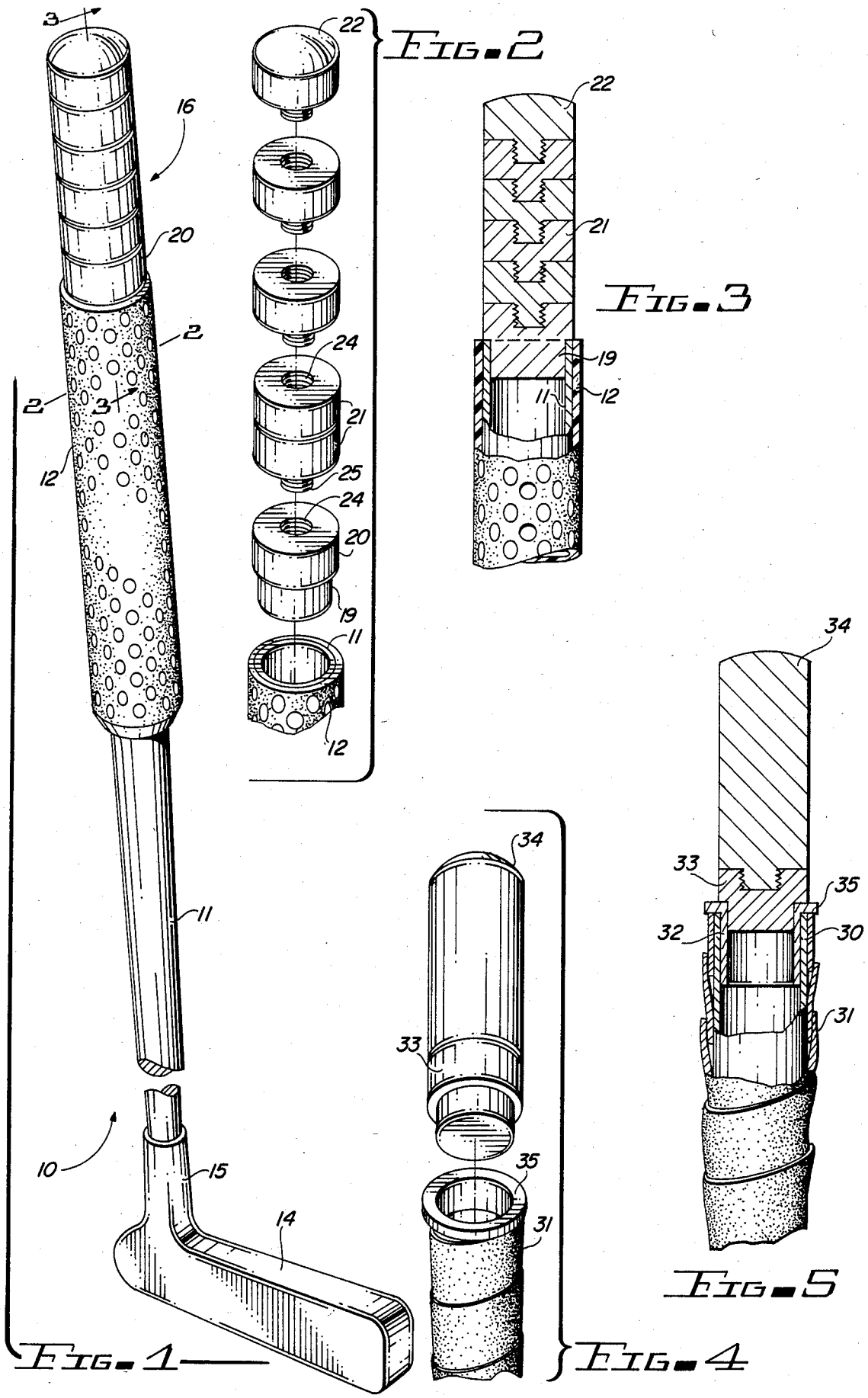
FIG. 1 is a view in perspective of a preferred embodiment of the invention utilized in connection with a golf putter.
FIG. 2 is an exploded view of the portion of the embodiment above line 2—2 in FIG. 1
FIG. 3 is a cross-section of the invention taken along line 3—3 of FIG. 1
FIG. 4 is a partial-view in perspective of a second embodiment of the invention.
FIG. 5 is a cross-sectional view of the embodiment of FIG. 4.

Referring now to FIG. 1, the present invention is shown incorporated in a golf putter 10 wherein the elongated hollow shaft 11 has a hand-grippable means 12 proximate to its free end and a typical blade type of clubhead 14 at the opposing end thereof. It is to be noted that the invention can be employed with other types of sporting devices including different clubheads, and the use in connection with a putter is but one example thereof.

The typical golf club has a hosel 15 which is used to fixedly join the clubhead 14 to the elongated shaft 11. The official rules of the governing body of the sport require a longitudinal shaft having a linear axis. The hand grippable portion 12 may be a molded anti-friction sleeve placed upon the free end of the hollow shaft or a spiral circumferential wrap of leather or the like. The type of wrap employed is discretionary with the user.

In the exploded view of FIG. 2 and cross-sectional view of FIG. 3, the weight means 16 of FIG. 1 is shown in increased detail with first section 20 having a region 19 of decreased diameter. Region 19 is inserted in the free end of hollow shaft 11 and secured by an epoxy resin or similar adhering agent. The embodiment of FIGS. 1, 2 and 3 has a molded handgrip which may include an integral end cap prior to installation of the weighting means 16 or may include a separate end cap or buttontype of insert. In either case, the material covering the free end of the shaft 11 is removed prior to insertion of the reduced diameter portion 19 of first section 20. In the embodiment shown, the weighting means was formed of brass and had total weight within the range of 6 to 8 ounces.

The first weighting section 20 contains a large diameter region whose diameter is approximately equal to the outside diameter of the shaft 11 at its free end. Thus when inserted into and secured within the shaft, the shoulder limits the depth of insertion, and the surface of the weighting means is a continuation of the surface of the shaft. A threaded recess 24 is centrally located on the first weighting section and is formed therein in axial alignment with the longitudinal axis of shaft 11. Each adjacent weighting section 21 is identical in that it is provided with a threaded recess 24 and a threaded member 25. As shown, the end section 22 contains a smooth end rather than a threaded recess.

As mentioned, the user prepares the golf putter for use with the invention by removing the material from the end of the club shaft 11, either taking out a button or by cutting away the end of a one piece molded grip, and then inserts and secures the first weighting section 20 therein. Next, one or more additional weighting sections are threaded on with all being in alignment with the shaft axis. The end cap 22 is threaded on to complete the assembly. The addition of weight beyond the hand-grippable region of the shaft increases the overall weight of the club and also raises the center of gravity of the club upwardly along the axis of the shaft toward or to the pivot point of the hand grip.

The intentional raising of the center of gravity toward the hand grip has been found to provide a more controlled and reproducible stroke during use. Since the point at which a club is gripped by the user varies with the player, the number of weighted sections 21 utilized can be readily varied to accommodate the "club feel" desired by the player. The use of the present invention has now allowed the user to grasp the club at the balance point or, if that feel is not quite that desired, control the distance between gripping and balance points by the addition or subtraction of threaded weighting sections from the end of the club.

A second embodiment of the invention is shown in FIGS. 4 and 5 wherein shaft 30 is provided with a conventional spiral-wrapped grip 31 of the type normally having an end cap placed in the free end of the shaft to assist in preventing the grip from unraveling during use. When the end cap (not shown) is removed to accommodate the present invention, the tendency of the spiral wrap to unravel is greatly reduced by the use of flanged tubular receiving member 32 which is slidably placed within the end of the shaft and secured by a suitable adhesive agent. The outwardly extending flange 35 overlies the wrap 31 at its exposed end thereby protecting it from the forces of wear.

The first weighted section 33 in this embodiment is provided with a lower portion of reduced diameter and is secured in member 32 in the same manner as first section 20 of the embodiment of FIG. 1. The second weighted section 34 is shown as an integral piece with a rounded-finish free end and a threaded insert on the opposing end. The first section 33 is provided with a threaded recess therein for receiving the second section. This embodiment does not permit the ready adjustment of the location of the center of gravity in relation to the hand gripping region but is intended for use by the player that has chosen to utilize only two club balancing points for his play.

While the above description has referred to specific embodiments of the invention, it is to be recognized that many variations and modifications may be made therein without departing from the scope of the invention as set forth in the claims appended hereto.

What I claim is:

1. An improved golf club wherein the player can alter both club weight and swing weight, said club comprising:

(a) a hollow shaft having a free end and an opposing end with a longitudinal axis extending therebetween;

(b) a club head affixed to said opposing end for contacting a golf ball;

(c) hand-grippable means located on said shaft proximate to the free end thereof;

(d) a first cylindrical weight having a first solid region of reduced diameter for insertion into the free end of said hollow shaft and a second region having a diameter equal to the outside diameter of said shaft and containing a threaded receiving means in alignment with said longitudinal axis;

(e) a second cylindrical weight having first and second ends, said second weight having a uniform outside diameter equal to the diameter of the second region of said first weight, said first end including a threaded fastening means in alignment with said longitudinal axis for coupling to the receiving means of said first weight; said second end containing a receiving means in alignment with said longitudinal axis; and (f) a solid weight having a threaded fastening means extending outwardly at one end thereof for engagement with said second weight and a smooth contour at the opposing end, the removal of said second weight altering club weight and swing weight of said golf club.

2. A golf club in accordance with claim 1 further comprising a third cylindrical weight having first and second ends, said third weight having a uniform outside diameter equal to the diameter of the second region of said first weight, said first end including a threaded fastening means in alignment with said longitudinal axis for coupling to the receiving means of said second weight, said second end containing a receiving means in alignment with said longitudinal axis, and said solid weight being attached to the second end of said third weight whereby a uniform surface weighted extension of said golf club is provided.

3. Apparatus for improving the balance of a golf club by permitting variation of the club weight and swing weight, said club comprising an elongated hollow shaft having a longitudinal axis and a free end containing a hand-grippable portion, the opposing end being provided with a club head for contacting a golf ball, said apparatus comprising:

(a) a first cylindrical weight having a first solid region of reduced diameter for affixation in the free end of said hollow shaft and a second region having a diameter equal to the outside diameter of said shaft and containing a threaded receiving means in alignment with said longitudinal axis;

(b) a second cylindrical weight having a uniform outside diameter of the second region of said first member and affixed in axial alignment with said first weight; and (c) a third weight containing a means for affixation to said second weight in axial alignment therewith, said third member being solid and possessing a smooth contour at its outer end.

* * * * *